United States Patent [19]

Larsson

[11] Patent Number: 4,658,800

[45] Date of Patent: Apr. 21, 1987

[54] GRINDING WHEEL PROFILE DRESSING DEVICE

[75] Inventor: Sture Larsson, Lidköping, Sweden

[73] Assignee: Lidkopings Mekaniska Verkstads AB, Lidkoping, Sweden

[21] Appl. No.: 769,142

[22] Filed: Aug. 26, 1985

[30] Foreign Application Priority Data

Aug. 31, 1984 [SE] Sweden ..... 8404350

[51] Int. Cl.[4] ..... B24B 53/00

[52] U.S. Cl. ..... 125/11 CD; 125/11 A

[58] Field of Search ..... 51/291, 165.93; 125/11 R, 11 CD, 11 A

[56] References Cited

U.S. PATENT DOCUMENTS

| | | | |
|---|---|---|---|
| 2,252,096 | 8/1941 | Pew | 51/291 |
| 3,031,808 | 5/1962 | Spicacci | 51/291 |
| 3,407,800 | 10/1968 | Hoare | 125/11 R |
| 4,048,764 | 9/1977 | Schmitz | 51/291 |
| 4,103,668 | 8/1978 | Nishimura | 125/11 CD |
| 4,274,231 | 6/1981 | Verega | 125/11 CD |

FOREIGN PATENT DOCUMENTS

| | | | |
|---|---|---|---|
| 478553 | 6/1929 | Fed. Rep. of Germany | 125/11 CD |
| 2026360 | 2/1980 | United Kingdom | 125/11 CD |

*Primary Examiner*—Harold D. Whitehead

*Attorney, Agent, or Firm*—Eugene E. Renz, Jr.

[57] ABSTRACT

A device for dressing a grinding wheel with an outer profile with the radius $R_1$ comprises a dressing roller having a circular dressing profile with the radius $R_2$. In order to admit dressing of grinding wheels with different profile radii $R_1$, the dressing roller and the grinding wheel can be moved so in relation to each other that the relative motion has the shape of a circular arc with the radius $R_2$–$R_1$, the radius being adjustable in order to obtain the desired profile radius of the grinding wheel.

1 Claim, 1 Drawing Figure

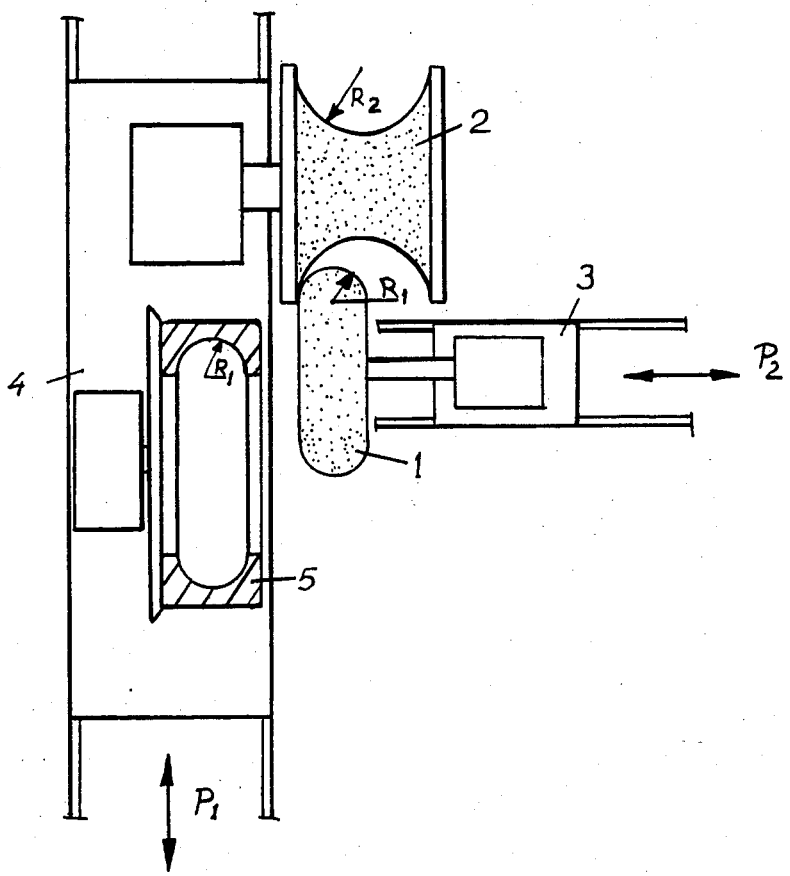
R2
2
R1
3
P2
4
R1
1
5
P1

GRINDING WHEEL PROFILE DRESSING DEVICE

FIELD OF THE INVENTION

The present invention relates to apparatus and method for dressing a grinding wheel with a circular axial section profile.

BACKGROUND OF THE INVENTION

A common and fast method of dressing a grinding wheel for e.g. grinding a raceway in a deep groove ball bearing is to use a rotating dressing roller with a peripheral profile corresponding to the profile of the raceway and to feed the dressing roller radially in relation to the grinding wheel into mutual contact during the dressing operation. Thereby the grinding wheel is given a profile which accurately conforms to the desired profile of the raceway.

One and the same dressing roller can in this case be used for one single raceway profile, and thus a plurality of different dressing rollers are necessary if rings with different raceway profiles are to be ground. Profiled dressing rollers are expensive and the method can be used in long series production, as the change of ring type requires change of dressing roller and thereby also a comparatively long adjustment time for the grinding machine.

In other connections, e.g. by German patent publication No. 1,281,885, it is known to make circular profiles on work pieces by letting tools with circular profiles perform arcuate translatory movements in relation to the work pieces. The tools in the known devices are, however, only usable for annular work pieces with a given diameter and can, therefore, not be used together with work pieces of different size. Furthermore, the double curved shape of the cutting surfaces of the tools is complicated as the profiles have different shapes in different parallel planes, which makes the tools complicated to manufacture.

SUMMARY OF THE INVENTION

The purpose of the present invention is to provide a device in which one and the same dressing roller, which roller has an uncomplicated shape, by a simple adjustment of the device can be used during grinding of work pieces with different profile radii and with which the profile radius of the grinding wheel can also easily be corrected.

This is achieved, according to the invention, thereby that a device conforming to the preamable of claim 1 is given the characterizing features stated in said claim.

Such a device makes it favourable to use a profiled dressing roller also when short series of work pieces are ground, where hitherto the most common procedure has been to dress the grinding wheel with a diamond point, which is complicated and time consuming.

BRIEF DESCRIPTION OF THE DRAWING

The following is a detailed description of the invention with reference to the accompanying schematic drawing, which shows, in a view in a plane parallel to the axes of rotation of the dressing roller and the grinding wheel, the principal design of a device according to a possible embodiment of the invention.

DESCRIPTION OF THE PREFERRED EMBODIMENT

The device is intended for dressing a grinding wheel 1 with a circular peripheral axial section profile. The profile radius of the wheel has the reference $R_1$. The peripheral of the wheel 1 is, during dressing, contacted by the periphery of a dressing roller 2 with a circular profile. The profile radius of the dressing roller has the reference $R_2$. The profile $R_2$ is concave in the embodiment shown, whereas the profile $R_1$ is convex. During the dressing operation the grinding wheel and the dressing roller are rotated around their respective axes in a manner known per se. The axes are usually parallel. The radii $R_1$ and $R_2$ are of unequal size, and the device is provided with means for bringing about an arc-shaped translatory motion of the dressing roller in relation to the grinding wheel in a plane comprising the axes of rotation of the dressing roller and the grinding wheel. The length of the radius of the arc is therewith equal to the difference between the larger and the smaller of the profile radii of the dressing roller and the grinding wheel. The desired motion can be brought about in many different ways. In the drawing a thinkable embodiment is sketched, according to which the grinding wheel 1 is arranged on a linearly movable longitudinal slide 3 and the dressing roller 2 is rotatably mounted on a cross slide 4 which is movable perpendicular to the motion of the slide 3 and also supports the spindle for the work piece 5 in a manner known per se.

The grinding wheel and the dressing roller are thus movable in relation to the machine frame in the directions of the arrows $P_1$ and $P_2$. Feeding of the respective slides can suitably be brought about in a conventional manner by servomotors connected to the respective slides 3, 4. The motors can, by means usually incorporated in the machine and in a manner known per se, be programmed so that they produce a relative motion of the grinding wheel and the dressing roller in the form of an arc, the radius of which being the difference between the known radii $R_2$ and $R_1$. By adjusting the feed of the respective slides any profile radius of the grinding wheel between O and $R_2$ can thus be dressed by a single dressing roller with the profile radius $R_2$. Furthermore, grinding wheels with different diameters can be dressed by a dressing roller of this kind. The device has thus a very broad range of use. No special feeding means for the dressing rollers are necessary, since the grinding machine is as a rule provided with means for adjusting the grinding wheel and the dressing roller on the machine frame.

Also other embodiments of the invention than the one described above are possible. For example, the relative motion between the grinding wheel and the dressing roller can be achieved by giving the grinding wheel or the dressing roller a circular translatory movement. The movement and its adjustability can be brought about by other means than the ones described above. The profile of the grinding wheel may be concave and the profile of the dressing roller may be convex, if the profile of the work piece is convex. The FIGURE shows an embodiment for internal grinding of an outer ring for a rolling bearing. The device can, of course, be arranged also for external grinding of, e.g. an inner ring for a rolling bearing.

What is claimed is:

1. A device for dressing of a grinding wheel (1) with a circular peripheral axial section profile by means of a dressing roller (2), which also has a circular peripheral axial section profile, one profile being concave and the other being convex, characterized by that the radii ($R_2$ and $R_1$) of the dressing roller and the grinding wheel are of different size, and by means (3, 4) for bringing about an arc-shaped translatory relative motion of the grinding wheel and the dressing roller in a plane comprising the axes of rotation of the dressing roller and the grinding wheel, the length of the radius of the arc being the difference between the larger and the smaller of the radii ($R_2$ and $R_1$) of the dressing roller and the grinding wheel, and for adjusting the radius of the arc, the axial width of the dressing roller (2) being greater than the axial width of the grinding wheel.

* * * * *